US007311046B2

(12) United States Patent
Riess et al.

(10) Patent No.: US 7,311,046 B2
(45) Date of Patent: Dec. 25, 2007

(54) BULLET FOR INFANTRY AMMUNITION

(75) Inventors: Heinz Riess, Furth (DE); Erich Muskat, Roth (DE); Erich Zeiher, Furth (DE)

(73) Assignee: Ruag Ammotec GmbH, Furth (DE)

( * ) Notice: Subject to any disclaimer, the term of this patent is extended or adjusted under 35 U.S.C. 154(b) by 0 days.

(21) Appl. No.: 10/475,140

(22) PCT Filed: Apr. 17, 2002

(86) PCT No.: PCT/EP02/04236

§ 371 (c)(1),
(2), (4) Date: May 10, 2004

(87) PCT Pub. No.: WO02/086414

PCT Pub. Date: Oct. 31, 2002

(65) Prior Publication Data

US 2004/0200376 A1 Oct. 14, 2004

(30) Foreign Application Priority Data

Apr. 19, 2001 (DE) ..... 101 19 156
Mar. 14, 2002 (DE) ..... 102 11 094

(51) Int. Cl.
*F42B 12/06* (2006.01)

(52) U.S. Cl. ..... 102/516; 102/503; 102/519

(58) Field of Classification Search ..... 102/503, 102/514, 515, 516, 517, 519
See application file for complete search history.

(56) References Cited

U.S. PATENT DOCUMENTS 932,014 A * 8/1909 Haase ..... 102/519
1,767,308 A * 6/1930 Phillips ..... 102/507
2,333,091 A * 11/1943 Crasnoff ..... 102/507
3,103,889 A * 9/1963 Keeney, Sr. ..... 102/506
3,143,966 A * 8/1964 Burns, Jr. et al. ..... 102/507
3,345,949 A * 10/1967 Nosler ..... 102/516
4,878,434 A * 11/1989 Sommet ..... 102/514
4,977,657 A * 12/1990 Engel et al. ..... 86/53
4,977,834 A * 12/1990 Denis ..... 102/439
5,641,937 A * 6/1997 Carter ..... 102/507
5,794,320 A * 8/1998 Wernz et al. ..... 86/55
5,939,662 A * 8/1999 Bootes et al. ..... 102/473
6,186,071 B1 2/2001 Fry
6,305,293 B1 * 10/2001 Fry et al. ..... 102/517
6,546,875 B2 * 4/2003 Vaughn et al. ..... 102/507

FOREIGN PATENT DOCUMENTS

AT DE 39 171 * 10/1909
GB 18589 * 0/1910
GB 1110507 * 4/1968

* cited by examiner

*Primary Examiner*—Stephen M. Johnson
(74) *Attorney, Agent, or Firm*—Antonelli, Terry, Stout & Kraus, LLP.

(57) ABSTRACT

The invention relates to a bullet for infantry ammunition comprising a bullet core (1), a bullet tip (13), and a metal case (2). The aim of the invention is to create a durable connection between the bullet core (1) and the metal case (2). To this end, the metal case (2) is a shell, which is open at the front and which is pulled onto the bullet core (1) from the rear. The bullet tip (13) projects away from the metal case (2), and a constriction (4) is provided on the bullet core (1). The case end (5) that is open at the front projects into this constriction.

7 Claims, 1 Drawing Sheet

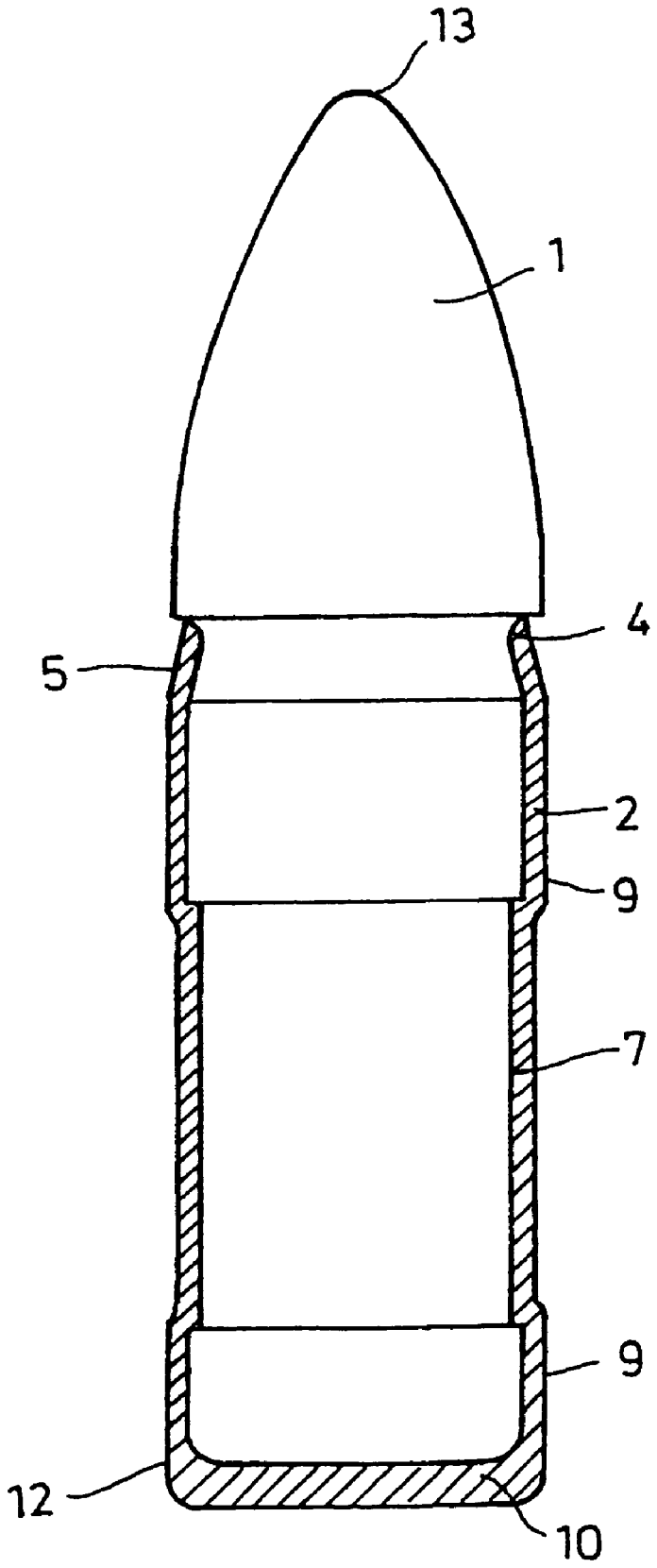
13
1
4
5
2
9
7
9
12
10

BULLET FOR INFANTRY AMMUNITION

The invention relates to a projectile for infantry ammunition according to the preamble of claim 1.

Projectiles for infantry ammunition in a known manner comprise a projectile core with a projectile nose and a metal casing, wherein the projectile core is made of lead. Firing lead projectiles generates lead-containing gases, which are detrimental to health. Lead moreover pollutes the environment.

The underlying object of the invention is to improve a projectile for infantry ammunition according to the preamble of claim 1 in such a way that a durable connection between projectile core and metal casing is achieved.

According to the invention this object is achieved in that the metal casing is a case, which is open at the front end and is drawn from the rear onto the projectile core, wherein the projectile nose projects from the metal casing and there is disposed on the projectile core a necking, into which the open front casing end projects.

The necking therefore holds the metal casing fast and prevents the latter from being pulled off upon penetration into a non-rigid medium. It is moreover highly advantageous that the casing end consequently lies in the flow shadow of the projectile nose.

In an advantageous development of the invention the projectile core is made of hardenable steel, tungsten, metal carbides, sintered metals or ceramic material.

The metal casing is preferably made of copper, a copper alloy, clad steel, soft iron or a zinc-tin alloy.

Advantageously at least one relief groove is disposed on the outer periphery of the projectile core, wherein the metal casing may rest in the region of the relief groove against the projectile core. These relief grooves may be of differing diameters and widths and may be arranged distributed over the entire length of the projectile.

A twist transmission is effected by the projectile portions having diameters that match the appropriate projectile calibre.

The base of the metal casing advantageously has a greater thickness than the wall thickness of the cylindrical part. The thickness of the base of the metal casing may however alternatively be less than or equal to the wall thickness of the cylindrical part. The base may be convex or concave with e.g. radii of between 0.5 and 10 calibres or flat. Alternatively the base of the metal casing may form a concave or convex cone point.

The shape of the rear of the metal casing may be conical with an angle of between 0° and 90°. The rear is the region of the metal casing adjoining the base.

The projectile core is advantageously roughened or knurled, thereby achieving a better seating of the projectile casing and/or metal casing on the projectile core.

Further features of the invention arise from the single drawing, which is described below.

The reference character 1 denotes the projectile core, which is made of hardenable steel, tungsten, metal carbides, sintered metals or ceramic material. The projectile core 1 has a projectile nose 13, which projects from a metal casing 2.

The metal casing 2 is made either of copper, a copper alloy, clad steel, soft iron or a zinc-tin alloy. Other metals are however also conceivable.

The metal casing 2 is drawn from behind, i.e. from the rear 12 onto the projectile core 1, wherein the projectile nose 13, as already mentioned, is exposed.

For the durable fastening there is disposed on the projectile core 1 a necking 4, into which the open front casing end 5 projects. The casing end 5 therefore lies in the flow shadow of the projectile nose 13 and has a continuous circular cross-section.

Provided on the outer periphery of the projectile core 1 there is in this particular case a single relief groove 7, whereby the metal casing 2 rests against the projectile core 1. It is however also possible to select a form of construction having a plurality of relief grooves, e.g. of differing widths and diameters.

A twist transmission is effected by projectile portions having cylinder diameters that match the appropriate projectile calibre (see e.g. portions 9).

The base 10 of the metal casing 2 has a greater thickness than the wall thickness in the cylindrical region. In this embodiment the base is flat. It may however alternatively be convex or concave with radii of between 0.5 and 10 calibres. The base shape may also be configured as a convex or concave cone point.

In the embodiment illustrated here, the rear 12 adjoining the base is of a cylindrical design. It may however alternatively be cone-shaped.

The projectile nose may be of any conventional shape, e.g. from pointed to flattened.

The invention claimed is:

1. Projectile for infantry ammunition comprising a projectile core made of hardenable steel, tungsten, metal carbides, sintered metals or ceramic material, and a metal casing, wherein the metal casing is a case, which is open at the front end and is drawn from behind onto the projectile core, wherein the projectile nose projects from the metal casing, there is disposed on the projectile core a necking, into which the open front casing end projects, at least one relief groove is disposed on the outer periphery of the projectile core in a direction traverse to a longitudinal direction of the projectile, the metal casing rests in the region of the at least one relief groove against the projectile core such that the projectile has at least one relief groove on an outer periphery of the casing, such that the outer periphery of the casing in a region in front of the at least one relief groove and in a region to the rear of the at least one relief groove is in the form of a cylinder having a cylinder diameter equal to a caliber of the projectile, that the casing comprises a base and a cylindrical part, that the at least one relief groove is provided in the cylindrical part, and that the base of the metal casing has a greater thickness than the wall thickness of the cylindrical part.

2. Projectile according to claim 1, characterized in that the projectile core is roughened or knurled.

3. Projectile according to claim 1, characterized in that the metal casing is made of copper, a copper alloy, clad steel, soft iron or a zinc-tin alloy.

4. Projectile according to claim 3, characterized in that the projectile core is made of hardenable steel and the metal casing is made of a copper alloy.

5. Projectile according to claim 1, characterized in that the projectile core is made of hardenable steel.

6. Projectile according to claim 1, characterized in that the metal casing is made of a copper alloy.

7. Projectile according to claim 1, characterized in that the projectile core has a one-piece construction.

* * * * *